US006043440A

United States Patent [19]

Sun et al.

[11] Patent Number: 6,043,440

[45] Date of Patent: Mar. 28, 2000

[54] MICROWAVE SWITCH CONTACT INTERFACE

[75] Inventors: Richard L. Sun, Redwood City; Piau Chee Lee, Cupertino, both of Calif.

[73] Assignee: Teledyne Industries, Inc., Los Angeles, Calif.

[21] Appl. No.: 09/151,549

[22] Filed: Sep. 11, 1998

[51] Int. Cl.[7] ..... H01P 1/12; H01H 9/00

[52] U.S. Cl. ..... 200/51.04; 333/105; 335/5; 200/16 R; 200/504; 200/275

[58] Field of Search ..... 200/1 R, 5 E, 200/16 R–16 E, 18, 50.32, 50.33, 50.35, 50.36, 51.03, 51.04, 518, 520, 243, 275, 284, 504; 310/328–331; 333/5, 103–109, 262; 335/4, 5, 104–106

[56] References Cited

U.S. PATENT DOCUMENTS

| | | | |
|---|---|---|---|
| 2,941,164 | 6/1960 | Lanctot | 333/7 |
| 2,997,669 | 8/1961 | Charles | 333/7 |
| 3,600,542 | 8/1971 | Richter | 200/166 H |
| 3,681,719 | 8/1972 | Treschitta et al. | 335/5 |
| 3,739,306 | 6/1973 | Sladek | 333/97 S |
| 4,298,847 | 11/1981 | Hoffman | 333/105 |
| 4,633,118 | 12/1986 | Kosugi | 310/328 |
| 4,855,699 | 8/1989 | Hoegh | 335/177 |
| 5,063,364 | 11/1991 | Tsoi | 333/107 |
| 5,281,936 | 1/1994 | Ciezarek | 335/4 |

*Primary Examiner*—Michael Friedhofer
*Attorney, Agent, or Firm*—Skjerven, Morrill, MacPherson, Franklin & Friel LLP; Elaine H. Lo

[57] ABSTRACT

A microwave switch includes a housing having at least three spaced coaxial conductor terminals extending from the housing; an electrical conductor extends inwardly from each of the terminals to a housing interior; and a housing cover effectively seals the housing and includes a pair of bearing apertures. A pair of switch operators, each having a headed top confines return springs between an underside of the headed top and a top surface of the cover, a central guide portion passes through said bearing apertures and a distal end protrudes from an underside surface of the cover into the housing interior toward the electrical conductors. A switch reed is fixedly attached to the distal end of each of the operators within said housing, each switch reed including reed distal ends which electrically interconnect, upon alternative operation of said operators by a rocker assembly, a pair of the electrical conductors including a common electrical conductor. The tip ends of the reeds are cantilevered over a shallow bore in the top of the common conductor and cantilevered over a crowned top surface of the non-common conductors.

14 Claims, 2 Drawing Sheets

MICROWAVE SWITCH CONTACT INTERFACE

BACKGROUND OF THE INVENTION

FIELD OF THE INVENTION

This invention relates to microwave switches. More particularly the invention is directed to a microwave switch which due to its construction has a ten-fold increase in rating namely to 10 million switching cycles.

BACKGROUND

Pertinent prior art to the present invention is seen in U.S. Pat. No. 4,298,847, 4,633,118 and 5,281,936. In the '847 patent a rocker alternatively actuates one of two headed operators slidable in a plate, the heads capturing a spring, or where non-headed guide members press against a spring under a reed. In both of these embodiments the tips of the heads can dig into the tops of the terminal conductors so as abraid the conductors and form debris affecting the cyclic life of the switch. Also the return spring action can abraid adjacent surfaces of the switch and resultant debris particles can find their way into the interface between reed contact surfaces and the terminal conductor(s) again detrimentally affecting cyclic life. A typical cyclic life of these patents is about 1,000,000 cycles (actuations). The '118 patent likewise has the return spring in a position where debris from the spring movement can access the housing interior. The '936 patent assigned to the same assignee as the present invention employs leaf springs, a rocker, a wobble plate and reeds to actuate various electrical contacts. U.S. Pat. No. 2,997,669 shows a lobing switch which also permits debris from return springs to access a housing interior which results in limited switch life.

FIG. 1 illustrates an electromechanical drive 10 for a prior art SPDT (Single Pole Double Throw) switch. The basic drive comprises two coils, 11, 12, two magnetic iron cores 14, 15, a permanent magnet 16, a magnetic iron support plate 17, and an iron magnetic rocker assembly 18 with rocker arms 18*a* and a rocker pivot 19 mounted on yoke 19*a*. These parts are arranged such that two permanent magnetic paths are developed: one for the open and the other for the closed switch position.

Since the closed magnetic path is significantly stronger than the open magnetic path, the rocker will remain in the selected position until it is acted upon by an opposing field. When a command pulse is applied to the coil in the closed magnetic path, the magnet iron rocker assembly is both repelled by the energized coil and attracted by the magnetic core of the opposite coil. This action latches the rocker assembly into position. The drive provides the force necessary to vertically move the center conductors i.e., either reed 22 or reed 23 (FIG. 2) in the RF body assembly by means of dielectric pins 20, 21 attached to the respective center conductor reeds. The reeds bridge across coaxial terminal 24 and coaxial common terminal 25 or across coaxial terminal 26 and common terminal 25, respectively, dependent on the rocker position.

More particularly the reeds are alternatively pressed down by the pivoting rockers to make contact with the respective terminal conductors 24–25 and 25–26, terminal conductor 25 being common. Return springs 27 are confined in bores 29 of a nickel-plated aluminum block 30. SMA female connectors 8 typically form the PORT 1, PORT 2 and RFCOM terminals. It has been found that the action of impacting the tops of the terminal conductors causes the square orthogonal under edges 28 of the distal tips of the reeds to dig into the top surface of both the conductors 24, 27 and the common conductor 25 causing debris to be formed. Also the abraiding action of the switch operators, i.e., the plastic, dielectric pins 20, 21, moving in the bores 29 against the hard Ni coating causes debris (plastic particles) which also "float" around in the interior of the switch housing block 30 and eventually create insulative deposits on the interface between the underside of the reeds 22, 23 and the tops of the conductors 24, 25, 26, lessening the cyclic life of the switch. The reeds typically are made of beryllium-copper. The switch shown in FIGS. 1 and 2 which has been commercialized by Applicant's assignee has a top rating of one million cycles.

SUMMARY

The microwave switch of the present invention increases the cyclic life of the FIG. 1 design by isolating the reed-terminal interface contact area in a closed housing and by providing that the return springs are outside of the closed housing. Further, the common central terminal contactor includes a central cut-out or shallow central bore or hollow so that the square edges of the distal ends of the two reeds accessing the common conductor(s) are thus spaced from the top of the common conductor and spaced from each other. The distal ends of the reeds thus cannot and will not dig into the terminal conductor top causing generation of debris particles. To compensate for any lost contact area due to the presence of the central bore or cut-out, a peripheral cylindrical lip may be provided at the top of the common terminal conductor to provide additional contact area approximating the radial contact area "lost" by the cut-out.

The microwave switch includes a separate contact housing having at least three spaced coaxial terminals extending from the housing, an electrical conductor extending inwardly from each of said terminals to the interior of the housing and a housing cover effectively sealing the top of the housing and including a pair of bearing apertures. A pair of switch operators, each having a headed top confine a spring between an underside of the headed top and a top surface of the cover, the operators also having a central guide portion passing through the bearing apertures and a distal end protruding from an underside surface of the cover into the housing interior. Each distal end is attached to a switch reed within the housing. Each switch reed includes reed distal ends which, upon alternative operation of operators by a rocker, electrically interconnect a pair of the terminal electrical conductors including a common terminal electrical conductor.

In another aspect of the invention a microwave switch includes a contact housing having at least three spaced coaxial conductor terminals extending from the housing, an electrical conductor extending inwardly from each of said terminals to a housing interior, a housing cover including a pair of switch bearing apertures, a pair of switch operators extending through bearing apertures, return springs and a switch reed attached to a distal end of each operator. Distal ends of the reeds, in alternative depression of the operators by a rocker, contact one conductor and a common electrical conductor and then another electrical conductor and that common electrical conductor respectively. The common electrical conductor includes a top distal surface having a shallow central bore and a raised peripheral edge for contact with an inboard portion of the distal end of respective reeds such that a tip of the distal ends overlies (is cantilevered over) the central bore. In a preferred embodiment, the distal surface of the non-common terminal electrical conductors have a crowned convexly curved surface so that the flat reed surface-to-the curved crowned surface contact area is inboard of the tips of the distal ends of the reeds.

DETAILED DESCRIPTION

Figure 1:
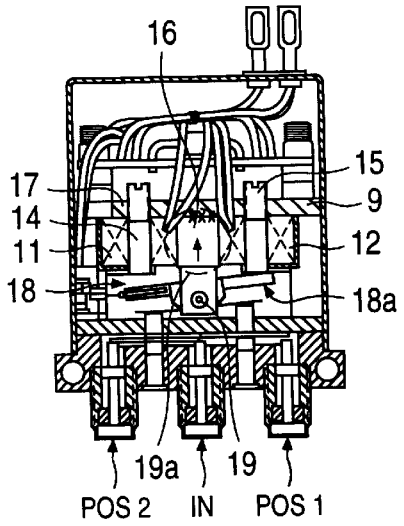
FIG. 1 (PRIOR ART)
FIG. 1 is a sectional side view of a prior art microwave switch.
Figure 2:
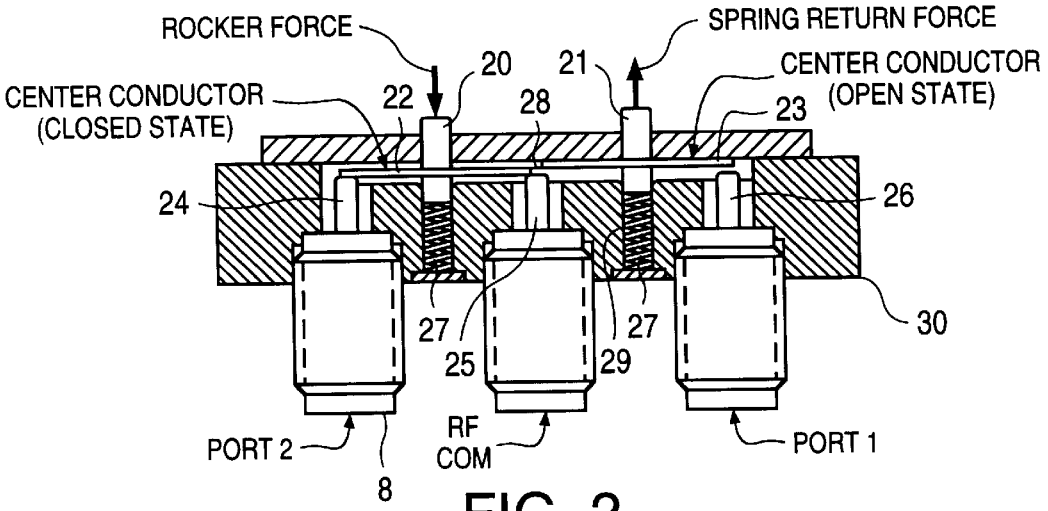
FIG. 2 (PRIOR ART)
FIG. 2 is a side view partially in section of a prior art switch interface.
Figure 3:
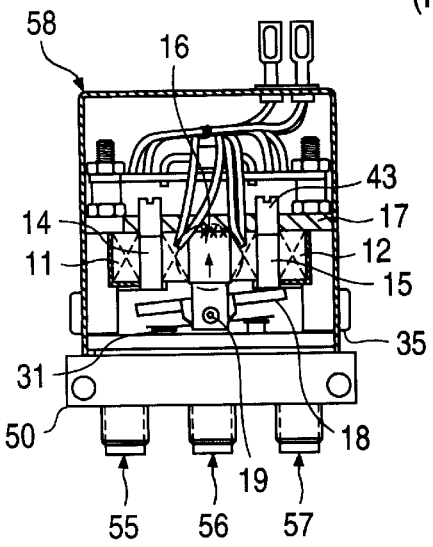
FIG. 3 is a side view of the switch of the invention with the rocker activation portion partially in section.
Figure 7:
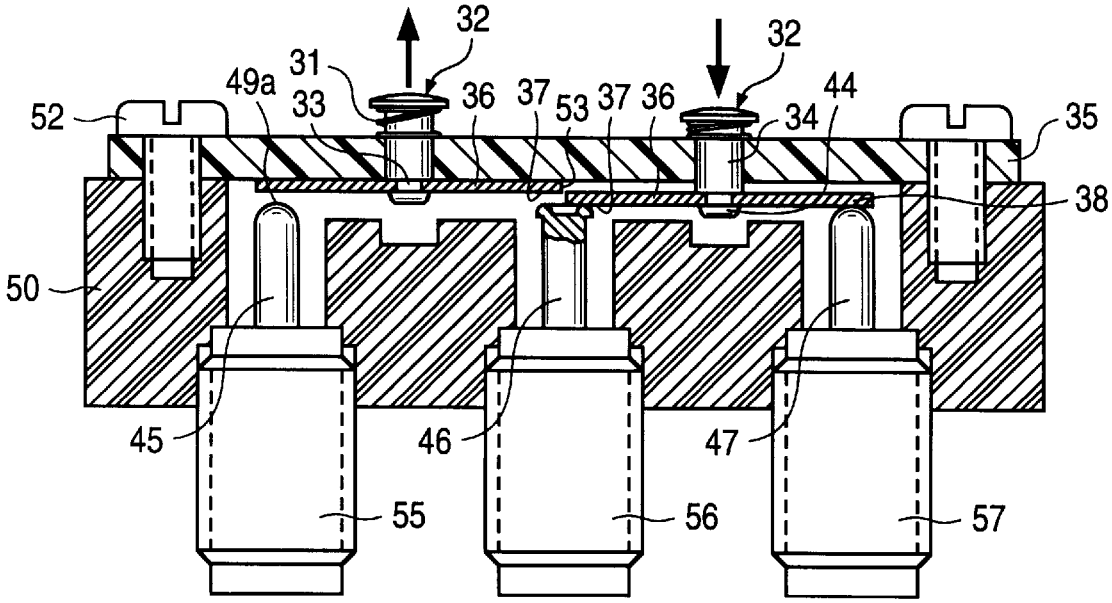
FIG. 7 is a schematic side view of the interface of the invention within the closed contact housing.

The numbered elements are hereafter numbered, for elements common to FIGS. 1 and 2, by the same numbers. FIG. 3 illustrates one embodiment of the invention where a closed housing 50 encompasses the terminal conductors 45, 46 and 47 (FIG. 7) extending from terminals 55, 56 and 57, and its coaxial conductor 46 being common. The housing 50 includes a closure 35 which prevents ingress of debris from any abrasive particles resulting from the movement of return springs. The housing and cover preferably are constructed of aluminum. The return springs 31 are mounted between a top surface of the cover 35 and the underside of a head 32*a* on at least a pair of headed operators 32, each also having an intermediate central guide portion 34 having a cylindrical peripheral surface passing in close sliding bearing contact with a bearing aperture 40 in the housing cover 35. A limited bearing clearance of about 0.05 mm is typically provided, the portion 34 having an outside diameter essentially the same as an inside diameter of coil spring 31. One distal end of coil spring 31 seats under the head of operator 32 and the other distal end of the spring abuts against a top surface 35*a* of the cover surrounding aperture 40. The springs 31 thus are completely separate from the interior of the housing 50. Countersunk apertures 41*a* receive threaded screws (not shown) for mounting plate 35 to the housing 50. The iron cores 14, 15 in the coils 11, 12 of the rocker assembly are secured into plate 17. Apertures 41 are provided at each corner of cover 35 for further attaching the cover to housing 50 by screws or fasteners 52 (FIG. 7). The rocker assembly including the coils are covered by a top housing 58 the bottom of which may abut top peripheral edges of housing 50 exteriorly of cover 35.

Figure 4:
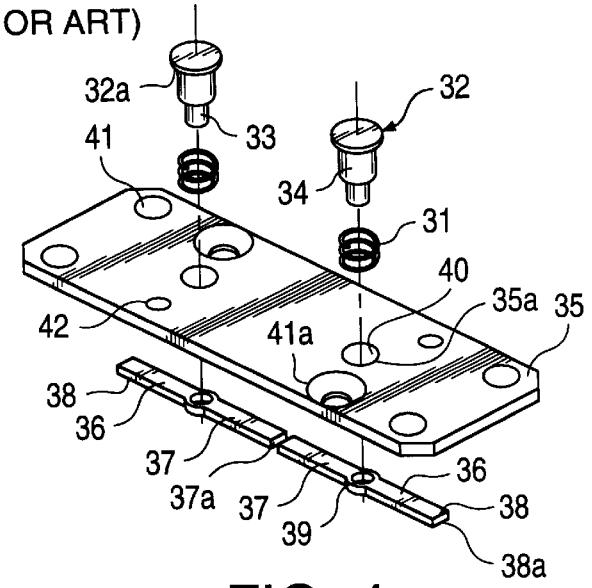
FIG. 4 is an exploded view of the housing cover, switch operators and reeds.
Figure 5:
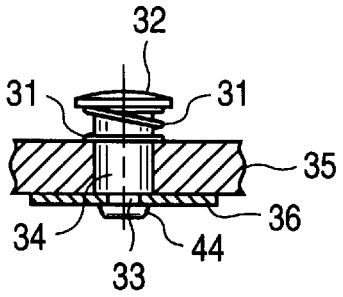
FIG. 5 is a detailed side view of the switch operator and reed per se, partially in section.

FIG. 4 shows more clearly the assembly of the headed operators 32, the springs 31 and the cover 35, as well as an operator tip portion 33 which is heat staked and upset after being passed into a central aperture 39 of respective reeds 36. Reeds 36 are typically constructed of beryllium-copper, preferably a heat-treated stiff Be—Cu material as is known in the art. FIG. 5 shows the operator as assembled to a reed, particularly showing the upset end 44 of the operator tip which, with a shoulder between the operator portions 34 and 33, firmly holds reed 36 relative to the operator 32. Each reed is the same in configuration including distal ends 37 having tips 37*a*, which when assembled are spaced from each other at 53 (FIG. 7) by a distance of from about 0.20 mm to about 0.50 mm. In one embodiment, the spacing is about 0.30 mm. The spacing is primarily dictated by the diameter of the common conductor 46 and avoidance of any contact of the respective distal end tips 37*a*. The other distal ends 38 of the reeds 36 include tips 38*a*.

Figure 6:
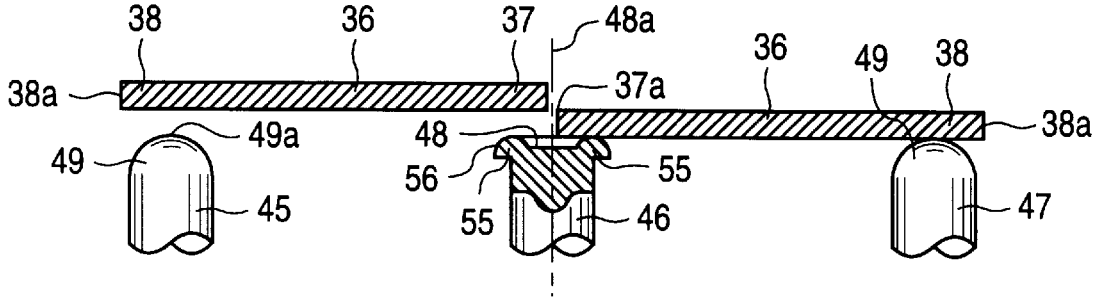
FIG. 6 is a schematic magnified side view of the reed-terminal conductor interfaces, with the reeds shown in cross-section.

In a second aspect of the invention (shown in FIGS. 6 and 7), to further prevent generation of debris leading to contamination of the interfacing contact between the underside of distal ends 37 and 38 of reeds 36 and the conductors 45, 46 and 47, the common conductor 46 is provided with a shallow central bore or cut-out 48 having a depth of from about 0.05 mm to about 1.0 mm and a diameter of from about 0.40 mm to 0.10 mm. These dimensions allow the reed tips 37*a* to overlie the bore 48 and be spaced from the bottom of the bore and spaced from the centerline 48*a* of the bore so as to prevent interference between the tips 37*a* of both reeds 36. The other distal ends 38 of the reeds 36 are positioned over respective terminal conductors 45 and 47 which are also designated herein as noncommon electrical conductors. Each of these non-common conductors 45 and 47 have a crowned convexly-curved distal surface 49 including a zenith 49*a*. The tips 38*a* of the non-facing distal ends 38 extend outwardly beyond the zenith 49*a* about 0.25 mm so that the tips 38*a* do not impact the distal tops of conductors 45 and 47 and thus the generation of debris is avoided since the tips 38*a* cannot dig into the tops of the conductors 45 and 47. A radius of curvature of from about 0.50 mm to about 1.5 mm may be used for the curved distal surface 49. Contact of an inboard portion of the distal ends makes electrical contact with the zenith 49*a* when one or the other reed is forced downward by the action of the rocker assembly as explained above.

With respect to the common conductor 46, the outside peripheral edge may be a rim 55 bounded by an upward extension (indicated by the dash line in FIG. 6) of the cylindrical surface of conductor 46 and thus having the same outer diameter as the remainder of conductor 46 under the rim. In a modification, also seen in FIG. 6, a lateral rim 56 may extend radially outwardly from the remainder of conductor 46 by a coining of the rim 55. With rim 56 present, the total contact area between the underside of the reeds distal ends 37 and the rim 56 of the common electrical conductor 46 may be approximately the same as an area represented by a width of the reed times a radius of the common electrical conductor base.

While the invention has been described in terms of a single pole double throw switch, the overall microwave switch may be a single pole multiple throw switch with 3–12 reeds and 3–12 corresponding operators, with multiple reeds contacting a common conductor, as seen in U.S. Pat. No. 5,281,936.

The above description of embodiments of this invention is intended to be illustrative and not limiting. Other embodiments of this invention will be obvious to those skilled in the art in view of the above disclosure.

We claim:

1. A microwave switch comprising:

a contact housing having at least three coaxial conductor terminals extending from the housing;

an electrical conductor extending inwardly from each of said terminals to a housing interior, the electrical conductors comprising a common electrical conductor and a plurality of non-common electrical conductors, the common electrical conductor including a distal surface having a shallow central bore and an outside peripheral edge;

a housing cover effectively sealing the housing and including at least two bearing apertures;

at least two switch operators, each of the switch operators having a headed top confining a spring between an underside of the headed top and a top surface of the cover, a central guide portion passing through one of said bearing apertures and a distal end protruding from an underside surface of the cover into the housing interior toward said electrical conductors; and a switch reed attached to the distal end of each of said operators within said housing, each of the switch reeds including reed distal ends which electrically interconnect, upon alternative operation of said operators, one of the plurality of non-common electrical conductors and the common electrical conductor;

wherein facing tips of reed distal ends which contact the common electrical conductor overlie the central bore.

2. The switch of claim 1 further including a switch rocker positioned above the top surface of the cover and being operable in alternative modes of operation to depress one or another of said switch operators against its associated spring to, in turn, depress one of the reeds into electrical interconnection with one of the plurality of non-common electrical conductors and the common electrical conductor.

3. The switch of claim 1 wherein each of the springs is a coil spring having an inside diameter, and the central guide portion of each of the switch operators has an outside diameter substantially equal to the inside diameter of the coil spring.

4. The switch of claim 1 wherein each of the operator distal ends extends in a heat staked interconnection through a central aperture in each of said reeds.

5. The switch of claim 1 wherein said electrical conductors are cylindrical and the common electrical conductor distal surface includes a lateral rim extending radially outward of a periphery of the common cylindrical electrical conductor.

6. The switch of claim 5 wherein a total contact area between the distal end of one of the reeds and the common electrical conductor distal surface is approximately equal to an area represented by a width of the distal end of the reed times a radius of a base of the cylindrical common electrical conductor.

7. The switch of claim 1 wherein the non-common electrical conductors include convexly-curved distal end surfaces such that non-facing tip portions of the reed distal ends are each spaced from an outer peripheral edge of the non-common electrical conductors.

8. The switch of claim 7 wherein the non-facing tip portions extend from a zenith point of the convexly curved distal end surfaces a distance of at least 10 mils.

9. A microwave switch comprising:

a housing having at least three coaxial conductor terminals extending from the housing;

an electrical conductor extending inwardly from each of said terminals to a housing interior, the electrical conductors comprising a common electrical conductor and a plurality of non-common electrical conductors, the common electrical conductor including a distal surface having a shallow central bore and a raised peripheral edge;

a housing cover including a plurality of switch apertures; and a plurality of switch operators extending through said apertures, each of the operators including a return spring and a switch reed attached to a distal end of the operator;

wherein each of said reeds includes distal ends which contact, in alternative operation of said operators, the raised peripheral edge of the common electrical conductor and one of the plurality of non-common electrical conductors, a tip portion of one of the distal ends of each of the reeds overlying the central bore.

10. The switch of claim 9 wherein said electrical conductors are cylindrical and the distal surface of the common electrical conductor includes a lateral rim extending radially outward of a periphery of the common cylindrical electrical conductor.

11. The switch of claim 10 wherein a total contact area between the distal end of one of the reeds and the common electrical conductor distal surface is approximately equal to an area represented by a width of the distal end of the one of the reeds times a radius of the cylindrical common electrical conductor.

12. The switch of claim 9 wherein the non-common electrical conductors include convexly-curved distal end surfaces such that non-facing tip portions of the reed distal ends are each spaced from an outer peripheral edge of the non-common electrical conductors.

13. The switch of claim 12 wherein the non-facing tip portions extend outwardly from a zenith point of the convexly curved distal end surfaces a distance of at least 10 mils.

14. The switch of claim 9 wherein the housing has from three to twelve bearing apertures, the switch including a corresponding number of reeds and switch operators in a single pole-multiple throw configuration.

* * * * *